US010475336B2

(12) United States Patent
Baik

(10) Patent No.: US 10,475,336 B2
(45) Date of Patent: Nov. 12, 2019

(54) SYSTEM FOR FORECASTING TRAFFIC CONDITION PATTERN BY ANALYSIS OF TRAFFIC DATA AND FORECASTING METHOD THEREOF

(71) Applicant: BLUESIGNAL CORPORATION, Daejeon (KR)

(72) Inventor: Seng Tae Baik, Daejeon (KR)

(73) Assignee: BLUESIGNAL CORPORATION, Daejeon (KR)

( * ) Notice: Subject to any disclaimer, the term of this patent is extended or adjusted under 35 U.S.C. 154(b) by 139 days.

(21) Appl. No.: 15/831,239

(22) Filed: Dec. 4, 2017

(65) Prior Publication Data

US 2019/0172344 A1 Jun. 6, 2019

(51) Int. Cl.
*G08G 1/01* (2006.01)

(52) U.S. Cl.
CPC ..... *G08G 1/0133* (2013.01); *G08G 1/0116* (2013.01); *G08G 1/0129* (2013.01)

(58) Field of Classification Search
CPC ... G08G 1/0133; G08G 1/0129; G08G 1/0116
See application file for complete search history.

(56) References Cited

U.S. PATENT DOCUMENTS 8,537,033 B2 * 9/2013 Gueziec ..... H04W 4/029 340/905
9,070,291 B2 * 6/2015 Gueziec ..... H04W 4/029
9,240,123 B2 * 1/2016 Stenneth ..... G08G 1/0125
9,489,838 B2 * 11/2016 Fowe ..... G08G 1/0133
2017/0042641 A1 * 2/2017 Voudouris ..... A61C 7/287
2017/0262790 A1 * 9/2017 Khasis ..... G05D 1/0287
2017/0323249 A1 * 11/2017 Khasis ..... G05D 1/0287
2018/0174448 A1 * 6/2018 Gomez Gutierrez .... G08G 1/08

FOREIGN PATENT DOCUMENTS

KR 2006-0037481 A 5/2006

* cited by examiner

*Primary Examiner* — Russell Frejd
(74) *Attorney, Agent, or Firm* — Maschoff Brennan

(57) ABSTRACT

The present invention relates to a system for forecasting the traffic condition pattern by an analysis of traffic data. The forecasting system thereof according to Example 1 of the present invention comprises a queue length estimation unit, which receives from a cloud server the information about vehicle passage time and speed of a first intersection or a second intersection, measured by a first beacon installed in the first intersection or a second beacon installed in the second intersection adjacent to the first intersection, and from the vehicle passage time and speed information of the first intersection or the second intersection, estimates the queue length of vehicles that entered the first intersection but did not pass the second intersection; a traffic estimation unit that uses the estimated queue length to calculate the traffic density by road segment between the first intersection and the second intersection, to thereby estimate the traffic; a traffic correction unit that corrects the estimated traffic data based on the historical data by road segment stored in the cloud server; and a traffic condition information calculation unit that applies data mining and pattern matching method to the corrected traffic data, to thereby calculate the traffic condition pattern and the traffic turning rate by time period and road segment.

9 Claims, 4 Drawing Sheets

SYSTEM FOR FORECASTING TRAFFIC CONDITION PATTERN BY ANALYSIS OF TRAFFIC DATA AND FORECASTING METHOD THEREOF

TECHNICAL FIELD

The present invention relates to a system for forecasting the traffic condition pattern by analysis of traffic data and the forecasting method thereof, and in particular, relates to a system for best forecasting the future traffic condition pattern by correcting the data of projected traffic based on the historical data by road segment, and the forecasting method thereof.

BACKGROUND ART

The matters disclosed in the Background Art section are provided to promote the understanding of the background of the invention, and thus, may include matters that are not conventional art known to one of ordinary skill in the art to which the present invention pertains.

The conventional traffic information system uses an electronic flow-type vehicle detector, in which electricity is flowed into a circular wire laid on the road, and the residual amount generated by the variation of magnetic flux, which changes with the movement of vehicles, is used to detect the vehicle speed, while CCTV camera or a speed sensor installed on the road is used as equipment for collecting particular traffic information. In the conventional traffic information system, the traffic information collected via said means is used to control traffic lights, provide wired or wireless traffic information to users, and send traffic information to users collected on a real-time basis.

Further, in recent times, with an increase in the user carrying a mobile communication terminal, various content service using such terminals are being provided. Among such content service is a service for receiving wireless information of the departing point and the destination from a mobile communication terminal installed in a moving vehicle, to give directions for the shortest paths from the departing point to the destination. For example, when the user inputs the name of the departing point or the destination into a mobile communication terminal or a separate navigation terminal in the form of voice or text, route information from the departing point to the destination is generated and is output to the user using voice, text and signal sound.

However, the conventional traffic information service has a problem of not being able to precisely forecast in real time the traffic condition of a road at a specific point of time based on the historical data by road segment. Moreover, the signal cycle by road segment, as well as the signal cycle of city block unit where many road segments belong to, cannot be optimized.

RELATED ART

Patent Documents

Patent Document 0001: KR-A-2006-0037481 (Mar. 28, 2007)

SUMMARY OF THE INVENTION

Problem to be Solved by the Invention

The present invention was made to solve the problem of the conventional art described above, and has an object to provide a system for forecasting the traffic condition pattern and the forecasting method thereof, which can forecast in real time the traffic condition of a road at a specific point of time based on the historical data by road segment stored in a cloud server.

Further, the present invention has an object to provide a system for forecasting the traffic condition pattern and the forecasting method thereof that can optimize not only the signal cycle by road segment but also that of city block unit where many road segments belong to.

Means for Solving the Problem

The system for forecasting the traffic condition pattern by an analysis of traffic data according to Example 1 of the present invention includes a vehicle queue length estimation unit, which receives from a cloud server the vehicle passage time and speed measured by a first beacon installed in a first intersection, or a second beacon installed in a second intersection adjacent to the first intersection, in which, from the vehicle passage time and speed information collected from the first intersection or the second intersection, the queue length of vehicles that entered the first intersection but did not pass the second intersection is estimated; a traffic estimation unit, which estimates the volume of traffic by calculating the traffic density by road segment between the first intersection and the second intersection using the estimated length of vehicle queue; a traffic correction unit, which corrects the data of estimated traffic based on the historical data by road segment stored in a cloud server; and, a traffic condition information calculation unit, which calculates the traffic condition pattern and traffic turning rate by time period and road segment by applying data mining and pattern matching method to the corrected data of traffic volume.

Here, the first beacon and the second beacon detect the time and speed of a vehicle passing the first intersection or the second intersection through a wireless communication with a passenger's portable terminal.

Further, the vehicle queue length estimation unit perceives a particular point in a road segment where the vehicle speed decreases from the set speed or more to a speed lower than the set speed, to thereby estimate the length of a vehicle queue.

The historical data refers to the driving speed and travel time of a specific time period and road segment.

The traffic correction unit analyzes the pattern of historical data, and corrects the traffic data representing an uncollected road segment and time period with the historical data of the relevant road segment and time period.

The traffic condition information calculation unit calculates a real-time signal cycle of the first intersection or the second intersection based on machine learning from the calculated traffic condition pattern and traffic turning rate by road segment.

The traffic turning rate refers to the rate of traffic turning right, the rate of traffic turning left and the rate of traffic bound straight with respect to the traffic inflow by road segment.

The traffic correction unit corrects the traffic data, estimated through pattern-matching of the estimated traffic data and the historical data by road segment, with the historical data by road segment of the highest similarity.

Also, the traffic correction unit calculates the Euclidean distance between the estimated traffic data and the historical data by road segment, and calculates the Euclidean distance into a value of similarity.

The method for forecasting the traffic condition pattern by an analysis of traffic data according to Example 1 of the present invention, in terms of a forecasting method of the traffic condition pattern using a system for forecasting the traffic condition pattern by an analysis of traffic data, includes a step of the first beacon installed in the first intersection, or the second beacon installed in the second intersection adjacent to the first intersection measuring the vehicle passage time and speed of the first intersection or the second intersection, and transmitting this information to the cloud server; a step of estimating the queue length of vehicles that entered the first intersection but did not pass the second intersection; a step of calculating the traffic density by road segment between the first intersection and the second intersection using the estimated queue length to thereby estimate the traffic volume; a step of correcting the estimated traffic data based on the historical data by road segment stored in a cloud server; and, a step of calculating the traffic condition pattern and traffic turning rate by time period and road segment by applying data mining and pattern matching method to the corrected traffic data.

Effects of Invention

According to the present invention, the traffic condition of a road at a specific point of time can be precisely forecasted in real time based on the historical data by road segment stored in a cloud server.

Furthermore, according to the present invention, not only the signal cycle by road segment, but also the signal cycle of city block unit where many road segments belong to, can be optimized.

DESCRIPTION OF EMBODIMENTS

The advantages and characteristics of the present invention and the methods to achieve thereof will be understood more clearly by referring to the attached drawings and Examples described below. However, the present invention is not limited to the Examples disclosed hereunder, and may be realized in a variety of forms. The Examples are provided merely to make the disclosure of the present invention complete, and to fully inform the scope of the invention to one of ordinary art in the skill to which the present invention pertains, and the present invention is merely defined by the scope of the claims.

Figure 1:
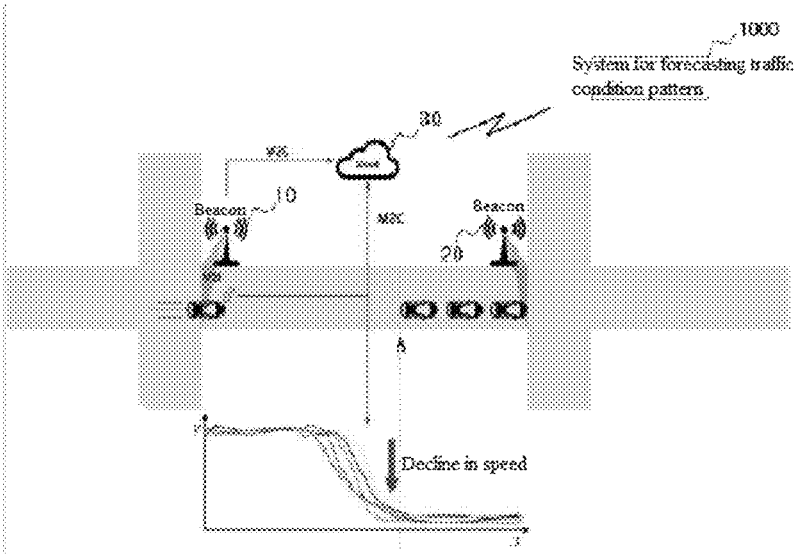
FIG. 1 is an outline drawing showing the road condition to describe a system for forecasting the traffic condition pattern by an analysis of traffic data according to Example 1 of the present invention.

FIG. 1 is an outline drawing showing the road condition to describe a system for forecasting the traffic condition pattern by an analysis of traffic data according to Example 1 of the present invention. According to FIG. 1, there are a first intersection and a second intersection on the road, in which vehicles pass or wait in a queue between the two intersections. Also, a first beacon 10 and a second beacon 20 are stationed in the first intersection and the second intersection, respectively, while a cloud server 30 is connected to the first beacon 10 and the second beacon 20 via radio communication, and since the cloud server 30 is connected wirelessly with the system for forecasting the traffic condition pattern, the system thereof can receive the information of vehicle passage time and speed of the first intersection or the second intersection from the cloud server 30.

On the portable terminal that enables wireless communication with the first beacon 10 or the second beacon 20, an application for forecasting the traffic condition pattern should be installed. As for a portable terminal, any terminal that is portable such as smartphone, tablet PC and PC may be used.

In the vehicle, a user carries a portable terminal, and when the vehicle has passed the first intersection and is about to pass the second intersection, the first beacon 10 detects the time and speed of the vehicle passing the first intersection through wireless communication with the user's portable terminal. Also, the second beacon 20 detects the time and speed of the vehicle passing the second intersection through wireless communication with the user's portable terminal.

When the vehicle has not passed the second intersection and waits in a queue, the second beacon 20 cannot detect the time and the speed of the vehicle passing through the second intersection. At this point, the length of the vehicle waiting in a queue can be estimated, wherein the queue length is estimated from the time and speed information of the first intersection or the second intersection. When the vehicle is waiting in a queue before passing through the second intersection, the vehicle speed gradually decreases, in which case the vehicle speed information can be used to estimate the queue length. x in FIG. 1 represents the distance separated from the first intersection, while v represents the vehicle speed. FIG. 1 shows that the vehicle speed dropped sharply after passing the first intersection, and the rate of speed decrease fell at a particular point A.

Figure 2:
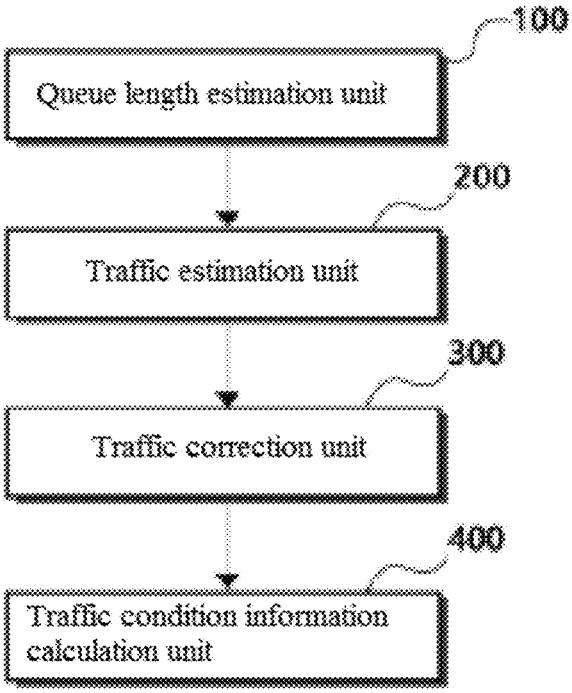
FIG. 2 is a block diagram of a system for forecasting the traffic condition pattern by an analysis of traffic data according to Example 1 of the present invention.

FIG. 2 is a block diagram of a system for forecasting the traffic condition pattern by an analysis of traffic data according to Example 1 of the present invention. According to FIG. 1 and FIG. 2, the system for forecasting the traffic condition pattern by an analysis of traffic data may comprise a queue length estimation unit 100, a traffic estimation unit 200, a traffic correction unit 300 and a traffic condition information calculation unit 400.

The queue length estimation unit 100 receives from the cloud server 30 the vehicle passage time and speed information of the first intersection or the second intersection measured by the first beacon 1 installed in the first intersection, or the second beacon 20 installed in the second intersection adjacent to the first intersection. Here, the first beacon 10 and the second beacon 20 detect the time and speed of the vehicle passing the first intersection or the second intersection through wireless communication with the portable terminal of a user in the vehicle. Then, the first beacon 10 or the second beacon 20 receives the vehicle passage time information from the portable terminal through V2I (Vehicle to Infrastructure) communication, and receives the vehicle passage speed information from the portable terminal through M2C communication.

Further, the queue length estimation unit 100 estimates the queue length of vehicles that entered the first intersection but did not pass the second intersection from the vehicle passage time and speed information of the first intersection and the second intersection. Here, the queue length estimation unit 100 perceives a particular point in a road segment (A in FIG. 1) where the vehicle speed decreases from the set speed or more to a speed lower than the set speed, to thereby estimate the length of a vehicle queue. The method of estimating the vehicle queue length is not limited thereto.

The traffic estimation unit 200 calculates the traffic density by road segment between the first intersection and the second intersection using the queue length estimated in the queue length estimation unit 100 to thereby estimate the traffic volume.

The traffic correction unit 300 corrects the traffic volume data estimated in the traffic estimation unit 200 based on the historical data by road segment (big data) stored in the cloud server. As such, the reason for correcting the estimated traffic volume data based on the historical data is to reflect the traffic data, generated by external force such as weather conditions and imperfection of hardware for data collection, to the estimated traffic data. By doing so, the unobtained traffic data of a particular place and point of time of a road can be corrected. The historical data includes the driving speed and travel time of a particular time period and road segment, but is not limited thereto.

Furthermore, the historical data by road segment (big data) stored in the cloud server 30 becomes massive with time, and thus, the estimated traffic data can be corrected more precisely. The reason for this is because the cloud server 30 is used, which, as a result, solves the conventional problem of not being able to store a massive amount of data.

The traffic correction unit 300 analyzes the pattern of historical data, and corrects the traffic data representing an uncollected road segment and time period with the historical data for the relevant road segment and time period. Specifically, the traffic correction unit 300 corrects the traffic data, estimated through pattern-matching of the estimated traffic data and the historical data by road segment, with the historical data by road segment of the highest similarity. Here, the traffic correction unit 300 calculates the Euclidean distance between the estimated traffic data and the historical data by road segment, in which the Euclidean distance is calculated in the value of similarity.

The traffic condition information calculation unit 400 applies data mining and pattern matching method to the traffic data corrected in the traffic correction unit 300 to calculate the traffic condition pattern and traffic turning rate by time period and road segment. Also, the traffic condition information calculation unit 400 calculates a real-time signal cycle of the first intersection or the second intersection based on machine learning from the calculated traffic condition pattern by road segment and the traffic turning rate. Machine learning, a technology to forecast the future by analyzing the big data that is massive in data generation, quantity, cycle and format, is already well-known, so further details are omitted. The real-time signal cycle is the cycle until the signal turns green again after the signal has changed to green, and a cycle until the signal turns red again after the signal has changed to red. The traffic turning rate is the rate of traffic turning right, turning left and going straight with respect to the traffic inflow by road segment.

Figure 3:
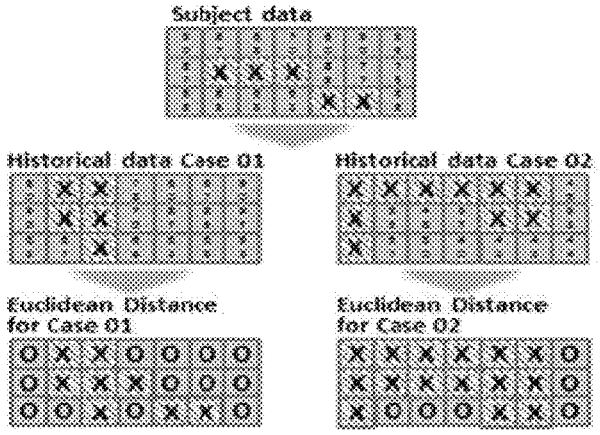
FIG. 3 is an outline drawing to describe the calculation of the Euclidean distance according to Example 1 of the present invention.

FIG. 3 is an outline drawing to describe the Euclidean distance calculation according to Example 1 of the present invention. In FIG. 3, the method of calculating the Euclidean distance from the estimated traffic data representing subject data and the historical data is described.

The cell marked as X in subject data and historical data by road segment is to show missing data in the estimated traffic data. The Euclidean distance, where it is marked X in subject data or historical data by road segment, is marked as X. FIG. 3 illustrates an example for two cases (Case 1, Case 2), and it is possible to know that the Euclidean distance has been calculated based on such principle.

Figure 4:
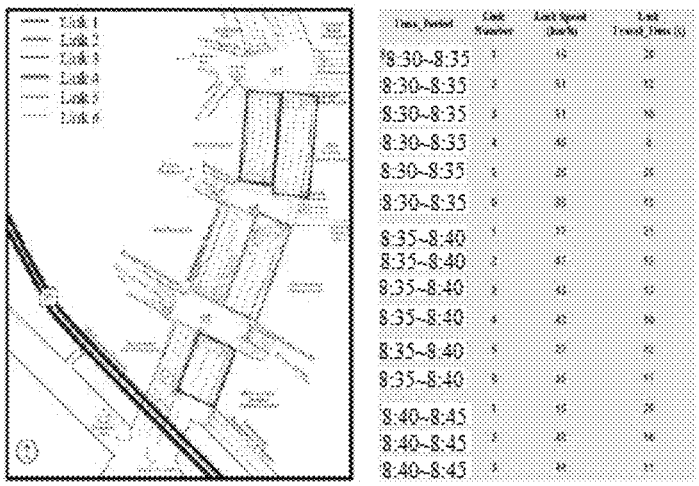
FIG. 4 is a screen showing the road segment and historical data according to Example 1 of the present invention.

FIG. 4 is a screen showing the road segment and historical data according to Example 1 of the present invention. In FIG. 4, the road segment and historical data are shown.

In FIG. 4, the rectangular shapes in the drawing on the left is a road segment between the two adjacent intersections, and the data on the right is the historical data having driving speed (Link Speed (km/h)) and travel time (Link Travel_Time (s)) for a particular time period (Time_Period) and a particular road segment (Link Number). The time period was set for every 5 minute, but is not limited thereto. The road segment is divided into 6, and each road segment in the drawing on the left is divided into Link 1, Link 2, Link 3, Link 4, Link 5 and Link 6.

The driving speed in Link 1 from 20:30 to 20:35 was 19 km/h, and the travel time was 28(s). The time period was set for every 5 minute, but is not limited thereto.

Figure 5:
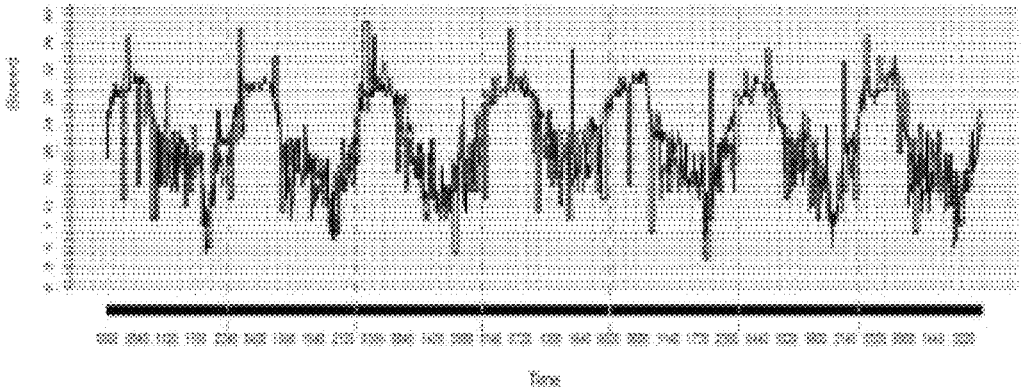
FIG. 5 is a screen showing the vehicle speed to time according to Example 1 of the present invention.

FIG. 5 shows the vehicle speed to time according to Example 1 of the present invention. By referring to FIG. 5, it is possible to know the change of vehicle speed at a particular road segment due to a passage of time.

The red line represents an estimated value of the vehicle speed, while the blue line represents an actual measurement value of the vehicle speed.

Figure 6:
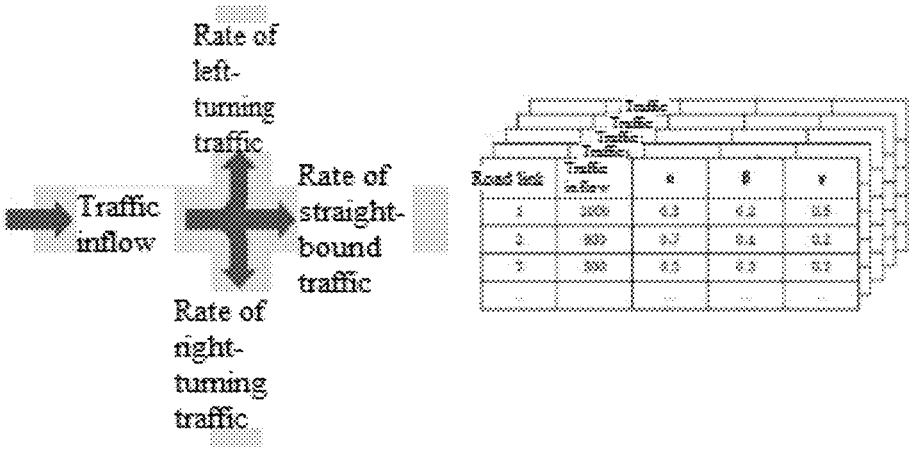
FIG. 6 is an outline drawing to describe the traffic turning rate according to Example 1 of the present invention.

FIG. 6 is an outline drawing to describe the traffic turning rate according to Example 1 of the present invention. FIG. 6 shows the traffic inflow, the rate of right-turning traffic ($\alpha$), the rate of left-turning traffic ($\beta$) and the rate of straight-bound traffic ($\gamma$) in road segment (road link) 1, 2 and 3.

The traffic inflow in Link 1 is 1,000, and the rate of right-turning traffic ($\alpha$), the rate of left-turning traffic ($\beta$) and the rate of straight-bound traffic ($\gamma$) is 0.3, 0.2 and 0.5, respectively; the traffic inflow in Link 2 is 800, and the rate of right-turning traffic ($\alpha$), the rate of left-turning traffic ($\beta$) and the rate of straight-bound traffic ($\gamma$) is 0.7, 0.3 and 0.2, respectively; and, the traffic inflow in Link 2 is 500, and the rate of right-turning traffic ($\alpha$), the rate of left-turning traffic ($\beta$) and the rate of straight-bound traffic ($\gamma$) is 0.5, 0.3 and 0.2, respectively.

Therefore, the rate of traffic turning right ($\alpha$) is the highest in Link 2, the rate of traffic turning left ($\beta$) is the highest in Link 3, and the rate of straight-bound traffic ($\gamma$) is the highest in Link 1.

Figure 7:
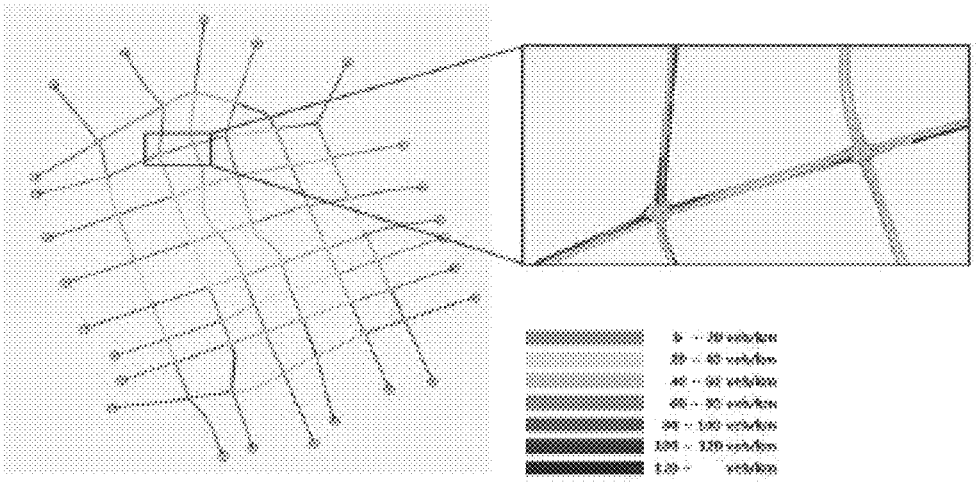
FIG. 7 is a screen showing the traffic data of multiple intersections in the unit of network according to Example 1 of the present invention.

FIG. 7 shows the traffic data of multiple intersections in the unit of network according to Example 1 of the present invention. In FIG. 7, each intersection is marked in different colors and the vehicle speed for each intersection is shown.

The figure shows that the vehicle speed increases from green to red. Based on this, the driver can travel to the destination by quickly identifying the route where the vehicle speed is high.

As for such road in the unit of network, one network can be set as multiple sub-networks, and the sub-network can be composed of multiple intersections. For example, in case of a highway, the sub-network may be set as segments where the traffic flow changes greatly, such as Yangjae IC-Daejeon IC segment and Daejeon IC-Bukdaegu IC.

Figure 8:
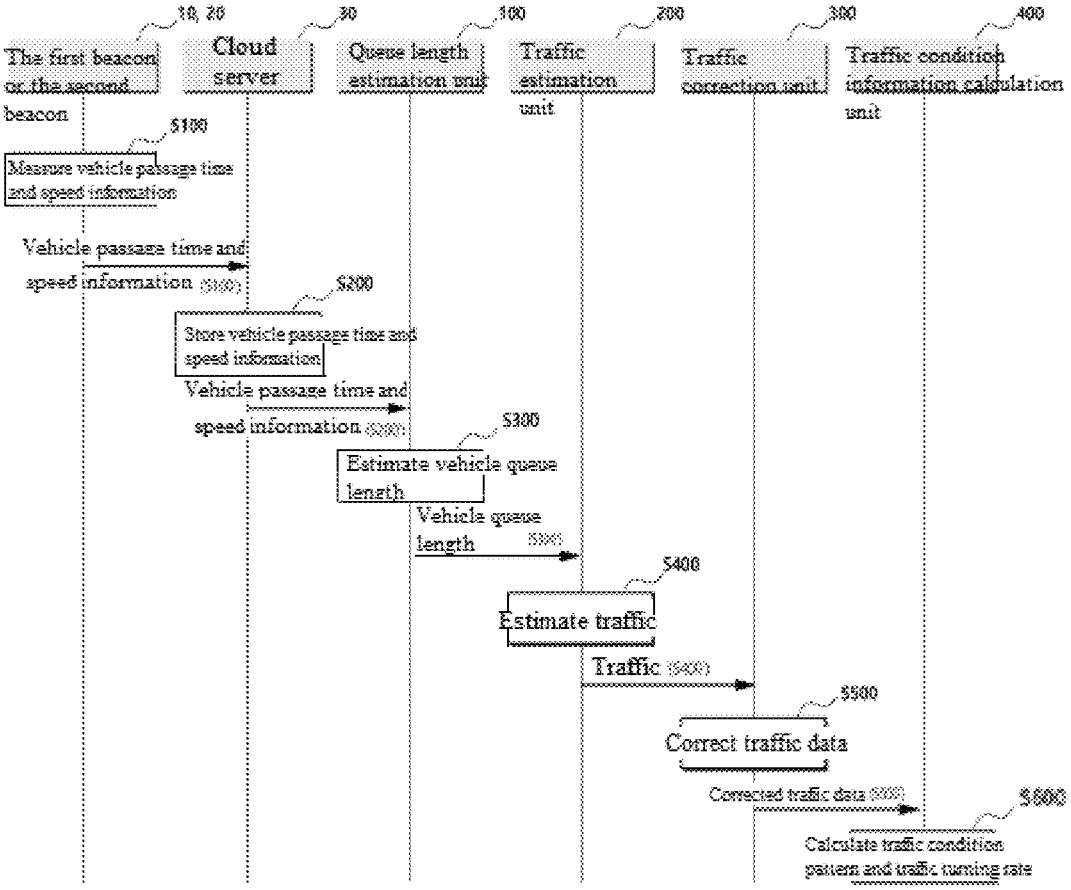
FIG. 8 is a flow chart of the forecasting method of traffic condition pattern by an analysis of traffic data according to Example 1 of the present invention.

FIG. 8 is a flow chart of the method for forecasting the traffic condition pattern by an analysis of traffic data according to Example 1 of the present invention. According to FIG. 1, FIG. 2 and FIG. 8, the method for forecasting the traffic condition pattern by an analysis of traffic data uses the system for forecasting the traffic condition pattern of FIG. 2, and is as follows. For detailed description of each step, refer to FIG. 1 and FIG. 2 described above.

Firstly, the first beacon 10 installed in the first intersection or the second beacon 20 installed in the second intersection adjacent to the first intersection measures the information about vehicle passage time and speed of the first intersection or the second intersection (S100) and transmits the information to the cloud server 30 (S100').

After S100', the cloud server 30 stores the vehicle passage time and speed information of the first intersection and the second intersection received from the first beacon 10 of the second beacon 20 (S200).

After S200, the queue length estimation unit 100 receives the vehicle passage time and speed information of the first intersection or the second intersection from the cloud server 30 (S200') to estimate the queue length of vehicles that entered the first intersection but did not pass the second intersection (S300).

After S300, the traffic estimation unit 200 receives the queue length estimated by the queue length estimation unit 100 (S300'), and by using the estimated queue length, the traffic density by road segment between the first and the second intersection is calculated, to thereby estimate the traffic volume (S400).

After S400, the traffic correction unit 300 receives the traffic data estimated by the traffic estimation unit 200 (S400'), and corrects the estimated traffic data based on the historical traffic data by road segment stored in the cloud server 30 (S500).

After S500, the traffic condition information calculation unit 400 receives the traffic data corrected by the traffic correction unit 300 (S500'), and applies data mining and pattern matching method to the corrected traffic data to calculate the traffic condition pattern and the traffic turning rate by time period and road segment (S600).

The above-mentioned Example of the present invention was described by referring to the Examples illustrated in the drawings, but it is merely an example, and anyone of ordinary skill in the art would understand that other Examples of various modification and parity are possible. Thus, the genuine scope of technical protection should be determined according to the attached claims.

EXPLANATION OF REFERENCE MARKS

10: The first beacon
20: The second beacon
30: Cloud server
100: Queue length estimation unit
200: Traffic estimation unit
300: Traffic correction unit
400: Traffic condition information calculation unit

The invention claimed is:

1. A system for forecasting the traffic condition pattern by an analysis of traffic data, which comprises a vehicle queue length estimation unit, which receives the information about vehicle passage time and speed of a first intersection or a second intersection measured by a first beacon installed in the first intersection or a second beacon installed in the second intersection adjacent to the first intersection from a cloud server, and from the vehicle passage time and speed information of the first intersection or the second intersection, estimates the queue length of vehicles that entered the first intersection but did not pass the second intersection;

a traffic estimation unit that uses the estimated queue length to calculate the traffic density by road segment between the first intersection and the second intersection, to thereby estimate the traffic;

a traffic correction unit that corrects the estimated traffic data based on the historical data by road segment of big data stored in the cloud server; and a traffic condition information calculation unit that applies data mining and pattern matching method to the corrected traffic data, to thereby calculate the traffic condition pattern and traffic turning rate by time period and road segment, and the first beacon and the second beacon detect the time and speed of a vehicle passing the first intersection or the second intersection through wireless communication with a passenger's portable terminal.

2. The system for forecasting the traffic condition pattern by an analysis of traffic data according to claim 1, wherein the queue length estimation unit perceives a particular point in a road segment where the vehicle speed decreases from the set speed or more to a speed lower than the set speed, to thereby estimate the length of a vehicle queue.

3. The system for forecasting the traffic condition pattern by an analysis of traffic data according to claim 1, wherein the historical traffic data is the driving speed and travel time of a particular time period and road segment.

4. The system for forecasting the traffic condition pattern by an analysis of traffic data according to claim 1, wherein the traffic correction unit analyzes the pattern of historical traffic data, and corrects the traffic data representing an uncollected road segment and time period with the historical data of the relevant road segment and time period.

5. The system for forecasting the traffic condition pattern by an analysis of traffic data according to claim 1, wherein the traffic condition information calculation unit calculates a real-time signal cycle of the first intersection or the second intersection based on machine learning from the calculated traffic condition pattern by road segment and the traffic turning rate.

6. The system for forecasting the traffic condition pattern by an analysis of traffic data according to claim 1, wherein the traffic turning rate is the rate of right-turning traffic, the rate of left-turning traffic and the rate of straight-bound traffic with respect to the traffic inflow by road segment.

7. The system for forecasting the traffic condition pattern by an analysis of traffic data according to claim 1, wherein the traffic correction unit corrects the traffic data, estimated through pattern-matching of the estimated traffic data and the historical data by road segment, with the historical data by road segment of the highest similarity.

8. The system for forecasting the traffic condition pattern by an analysis of traffic data according to claim 7, wherein the traffic correction unit calculates the Euclidean distance between the estimated traffic data and the historical data by road segment, and calculates the Euclidean distance into a value of similarity.

9. A method for forecasting the traffic condition pattern using a system for forecasting the traffic condition pattern by an analysis of traffic data, which comprises a step of a first beacon installed in a first intersection, or a second beacon installed in a second intersection adjacent to the first intersection, measuring the information about vehicle passage time and speed of the first intersection or the second intersection, and transmitting the information to a cloud server;

a step of receiving the information about vehicle passage time and speed of the first intersection or the second intersection from the cloud server, and estimating the queue length of vehicles that entered the first intersection but did not pass the second intersection;

a step of calculating the traffic density by road segment between the first intersection and the second intersection using the estimated queue length, to thereby estimate the traffic;

a step of correcting the estimated traffic data based on the historical data by road segment of big data stored in the cloud server; and a step of applying data mining and pattern matching method to the corrected traffic data to calculate the traffic condition pattern and the traffic turning rate by time period and road segment, and the first beacon and the second beacon detect the time and speed of a vehicle passing the first intersection or the second intersection through wireless communication with a passenger's portable terminal.

* * * * *